United States Patent [19]

Kinsman

[11] 4,210,364

[45] Jul. 1, 1980

[54] PORTABLE FOOT REST

[76] Inventor: Calvin T. Kinsman, 1401 Bamboo La., New Port Richey, Fla.

[21] Appl. No.: 4,766

[22] Filed: Jan. 19, 1979

[51] Int. Cl.[2] ..... A47C 9/12; A47C 4/52

[52] U.S. Cl. ..... 297/439; 297/183

[58] Field of Search ..... 297/183, 438, 439, 462

[56] References Cited

U.S. PATENT DOCUMENTS

| | | | |
|---|---|---|---|
| 2,566,498 | 9/1951 | Revercomb | 297/439 |
| 2,614,613 | 10/1952 | Bushong | 297/438 |
| 2,902,195 | 9/1959 | Marshall | 297/183 X |

*Primary Examiner*—James C. Mitchell

*Attorney, Agent, or Firm*—Arthur W. Fisher

[57] ABSTRACT

A portable foot rest configured and designed of strong, light weight material, to support the user's feet above the floor to such that pressure is not exerted on the underside of the lower portion of the upper legs wherein the portable foot rest comprises a support member including a base surface to engage the floor and a substantially parallel horizontal support surface to directly support the feet, the distance or thickness between the substantially parallel base surface and support surface is at least two inches, a carrying handle coupled to the support member by the substantially flexible cord and a storage portion comprising a groove or channel in combination with a seat formed in the base such that the channel and seat cooperatively form a recess to receive the carrying handle for storage when not in use.

8 Claims, 2 Drawing Figures

FIG. 1
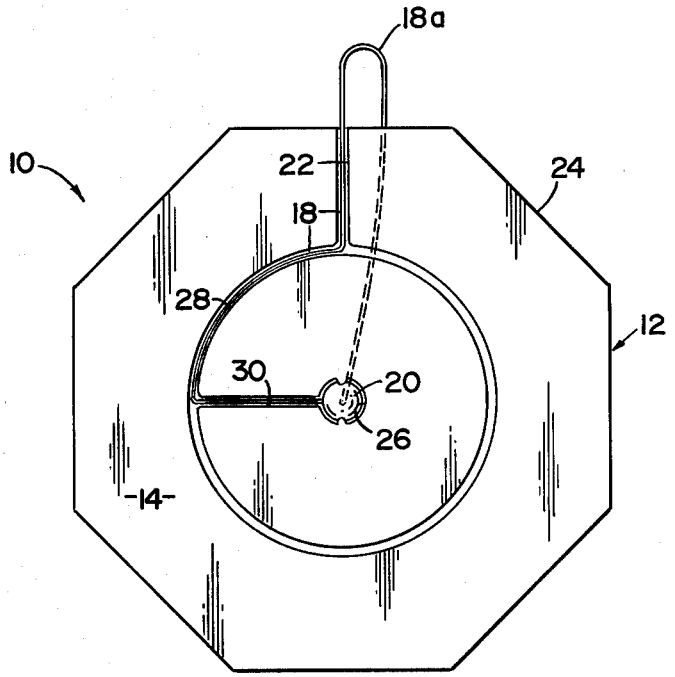
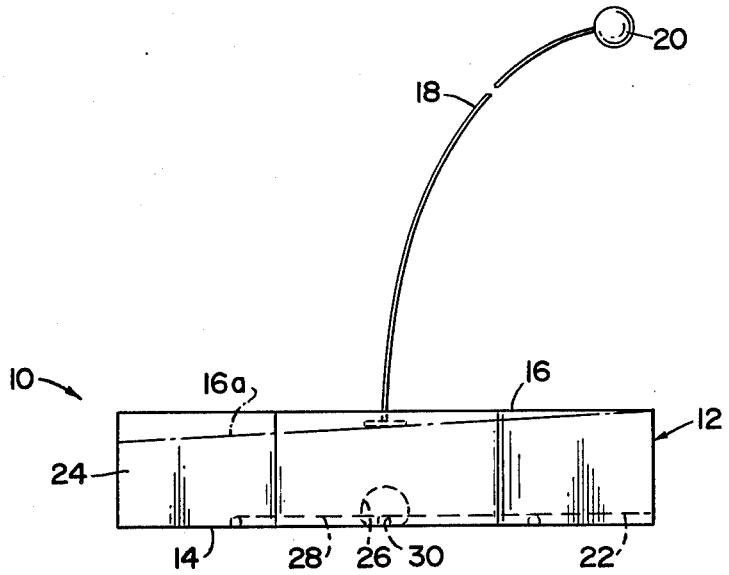
FIG. 2

PORTABLE FOOT REST

BACKGROUND OF THE INVENTION

1. Field of the Invention

A portable foot rest designed to support the user's feet above the floor or like supporting surface so that pressure is not exerted on the underside of the lower portion of the upper legs.

2. Description of the Prior Art

Many persons and particularly women have circulation problems in the lower legs associated with muscular cramps, swelling of ankles and soreness. This is compounded when such persons are short in stature where when seated their feet barely, if at all, touch the floor. The weight of the lower legs and feet thus are supported partly by the edge of the chair causing undue compression of tissue behind the knees. Moreover major blood vessels which supply circulation to the lower leg and foot pass through the space behind the knees such that the weight of the legs dangling from a chair or other seat, causes some compression of these major blood vessels. This compression or pressure prevents normal return circulation from the lower legs and feet. Thus the problems of the feet, ankles, and lower legs are exascerbated. Examples of the prior art are reflected in U.S. Pat. Nos. 277,880; 402,130; 2,614,613; 3,961,822; 4,090,268.

In contrast, the instant invention is designed to effectively correct this difficulty or condition, by providing a light, strong, foot rest which can be readily moved about the home as needed and can also be taken to public places as church, theatre, concert hall and the like. The device is compact, of pleasing appearance, and is a great comfort to the user by allowing an unimpeded circulation of blood to the lower legs when the impediment is caused by the above conditions.

SUMMARY OF THE INVENTION

The subject invention relates to a portable foot rest 10 configured and designed of strong light weight material of sufficient height to support the user's feet above the floor or other supporting surface such that pressure is not exerted on the underside of the lower portion of the upper legs. More specifically the portable foot rest comprises a support member to engage the floor or other supporting surface to directly support the feet when in use. For suitable use the distance or thickness of the support member is at least two inches.

Extending upwardly and affixedly attached to the support member, preferably to the center portion of the support member, is a substantially flexible cord having a handle attached to the opposite end thereof. This handle may comprise a small ball or other suitable handle such that the handle and flexible coupling means in combination comprise a carrying means. It should be noted that the length of the cord may be as much as three feet long permitting the user to simply hang the handle means over a chair table or the like when not in use thus avoiding the necessity of bending over to grasp the portable foot rest when moving from place to place, and when in use the ball (handle) may be simply laid in the user's lap.

A storage means is formed on the support member comprising a channel or groove extending inwardly from the periphery of the support member in communication with a seat to form a recess to receive the flexible cord and handle means when the portable foot rest is stored.

As seen from this unique combination of elements applicant has provided and combined a support member in combination with a carrying means which facilitates the use amd carriage of the portable foot rest from place to place within a house or other similar enclosure without the necessity of the user continually bending over while moving from place to place to grasp and move the portable foot rest itself. Moreover, the storage means comprising the recess formed in the support member permits storing the entire portable foot rest when the cord and handle are stored therein.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a bottom view of a portable foot rest.

FIG. 2 is a side view of the portable foot rest.

Similar reference characters refer to similar parts throughout the several views of the drawings.

DETAILED DESCRIPTION OF THE PREFERRED EMBODIMENT

As shown in FIGS. 1 and 2, the subject device relates to a portable foot rest generally indicated as 10 configured and designed of strong light weight material such as plastic, metal or the like of sufficient height to support the user's feet above the floor or other supporting surface such that pressure is not exerted on the underside of the lower portion of the upper legs. More specifically, the portable foot rest 10 comprises a support member 12 including a base surface 14 to engage the floor and a substantially horizontal support surface 16 parallel to the base surface 14 to directly support the feet when in use. Of course, the support surface 16 may be inclined as indicated by dot-dash line **16*a*. It is envisioned that the support member 12 may comprise a circular or any multiangular design or configuration. For suitable use, the distance or thickness between the substantially parallel base surface 14 and support surface 16** is at least two inches.

Extending upwardly and fixedly attached preferably to the center portion of the support member 12 is a substantially flexible cord 18. Attached to the opposite end of the substantially flexible cord or coupling means is a carrying handle 20. This handle may comprise a small ball or other suitable handle such that the carrying handle 20 and flexible coupling means 18 in combination comprise a carrying means. It should be noted that the length of the cord 18 may be as much as three feet long, permitting the user to simply hang the carrying handle 20 over a chair, table or the like when not in use thus avoiding the necessity of bending over to grasp the portable foot rest 10 when moving from place to place; and to place the handle in his lap when using the foot rest to support his feet, thus facilitating short moves from chair to chair.

A storage means is formed on the base surface 14 as described more fully hereinafter. Specifically, the storage means comprises a first portion 22 extending inwardly from the periphery 24 of the support member 12 in communication with a seat 26 such that the first portion and the seat form a recess in the base surface 14 to receive the flexible cord 18 and carrying means 20 when the portable foot rest 10 is stored.

The storage means may further include a second portion 28 of arcuate configuration and a third portion 30 each in communication between the first portion 22 and the seat 26. In the configuration envisioned, as shown, the first portion 22 is substantially perpendicular to the tangent to the outer peripheral surface 24 while the third portion 30 is disposed substantially perpendicular to the axis of the first portion 22. As seen from this unique combination of elements, applicant has provided and combined a support member 12 in combination with a carrying means which facilitates the use and carriage of the portable foot rest 10 from place to place within a house or other similar enclosure without the necessity of the user continually bending over while moving from place to place to grasp and move the portable foot rest 10 itself. Moreover the storage means or recesses formed in the base surface 14 of the support member 12 permits storing the entire portable foot rest 10, when the cord 18 and handle 20 are disposed therein. Further the foot rest 10 can be easily carried extended distances by means of the carrying loop 18*a* extending outwardly from the periphery of the foot rest, when the handle 20 and a portion of the cord 18 is placed in the above described storage areas.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statememts of the scope of the invention which, as a matter of language, might be said to fall therebetween.

Now that the invention has been described,

What is claimed is:

1. A portable foot rest to support the operator's feet above the floor of like surface so that the pressure from the weight of the legs is not exerted on the underside of the lower portion of the legs, said portable foot rest comprising a support member comprising a base surface and a support surface disposed in spaced relationship relative to each other, for supporting the feet above the floor or like surface in combination with the carrying means for transporting said portable foot stool from place to place said carrying means comprises a handle means having a substantially spherical configuration coupled to said support member by a substantially flexible cord, a storage means formed in said support means to receive said carrying means when said portable foot rest is not in use, said storage means is formed in said base surface said storage means comprising a first portion extending inwardly from the periphery of said support member in communication with a seat such that said first portion and said seat form a recess in the surface of said base to receive said flexible cord and said handle means when said portable foot rest is stored.

2. The portable foot rest of claim 1 wherein said storage means further includes a second portion communicating between said first portion and said seat to receive the midportion of said flexible cord.

3. The portable foot rest of claim 2 wherein said storage means further includes a third portion disposed between said second portion and said seat to receive the inner portion of said flexible cord.

4. The portable foot rest of claim 3 wherein said first portion extends inwardly substantially perpendicular to the tangent formed on the periphery of said base surface, said second portion comprises an arcuate portion and said third portion is substantially perpendicular to said first portion.

5. The portable foot rest of claim 1 wherein the surface of said base and the surface of said substantially horizontal support surface are at least two inches in thickness relative to each other.

6. The portable foot rest of claim 1 wherein a portion of said substantially flexible cord extends outwardly from the periphery of said support member to form a carrying loop when said carrying means is operatively disposed with said storage means.

7. The portable foot rest of claim 1 wherein said base surface and said support surface are substantially parallel to each other.

8. The portable foot rest of claim 1 wherein said support surface is inclined diagonally relative to the plane of said base surface.

* * * * *